United States Patent [19]

Miller

[11] Patent Number: 4,955,648

[45] Date of Patent: Sep. 11, 1990

[54] DOOR SECURITY APPARATUS

[76] Inventor: Harmon R. Miller, 16631 Cromarty Ct., Houston, Tex. 77084

[21] Appl. No.: 362,574

[22] Filed: Jun. 7, 1989

[51] Int. Cl.[5] ..... E05C 19/18

[52] U.S. Cl. ..... 292/258; 292/288

[58] Field of Search ..... 292/258, 244, 288, 347, 292/297, 298, 303, 17

[56] References Cited

U.S. PATENT DOCUMENTS

| | | | |
|---|---|---|---|
| 893,463 | 7/1908 | Denny et al. | 292/297 |
| 1,239,802 | 9/1917 | Macbeth | 292/258 |
| 1,571,543 | 2/1926 | Fratzke | 292/258 |
| 2,151,587 | 3/1939 | Cassileth | 292/288 |
| 3,791,096 | 2/1974 | Epperlein | 292/17 X |
| 4,012,065 | 3/1977 | Miller | 292/288 |
| 4,082,334 | 4/1978 | Volta et al. | 292/288 |
| 4,334,705 | 6/1982 | Rumph | 292/288 |
| 4,575,140 | 3/1986 | Dargis | 292/288 |
| 4,770,450 | 9/1988 | Docus | 292/258 |

*Primary Examiner*—Richard E. Moore

*Attorney, Agent, or Firm*—Browning, Bushman, Anderson & Brookhart

[57] ABSTRACT

A security apparatus for preventing opening of a hinged door from the inward swinging side, the door being received in a door frame having a door facing on the outward swinging side, the door including a door knob extending from the outward swinging side, the door knob having a shaft portion, the apparatus having a web portion having first and second spaced ends, a first flange portion depending in a first direction from the first end of the web portion and generally transversely thereto, the first flange portion having a first notch for receiving the shaft portion, a second flange portion depending in the second direction from a second end of the web portion and generally transversely thereto, the second flange portion having an inner surface which faces in a direction toward an imaginary plane passing through the first flange portion transversely to the web portion such that when the door is closed and the shaft position of the door knob on the outward swinging side is received in the notch of the first flange portion, the inner surface of the second flange portion abuts or lies closely adjacent the door facing on the outward swinging side of the door.

10 Claims, 3 Drawing Sheets

FIG. 4
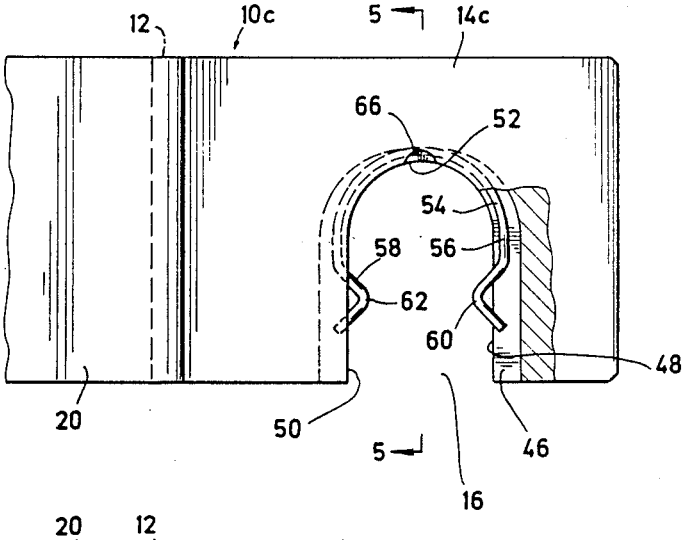
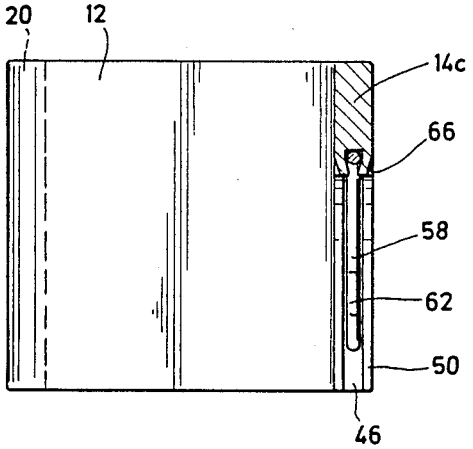
FIG. 5
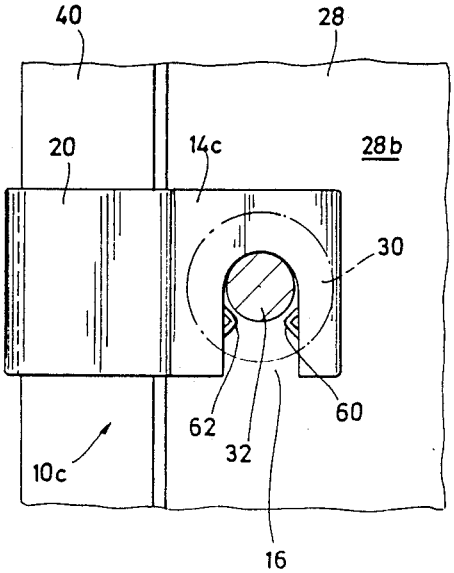
FIG. 6
FIG. 7
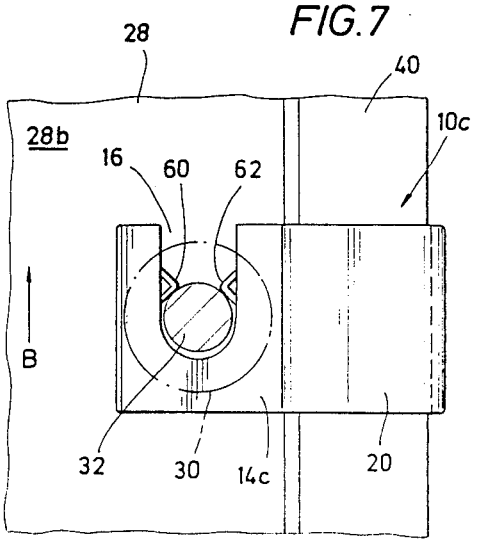

FIG. 8
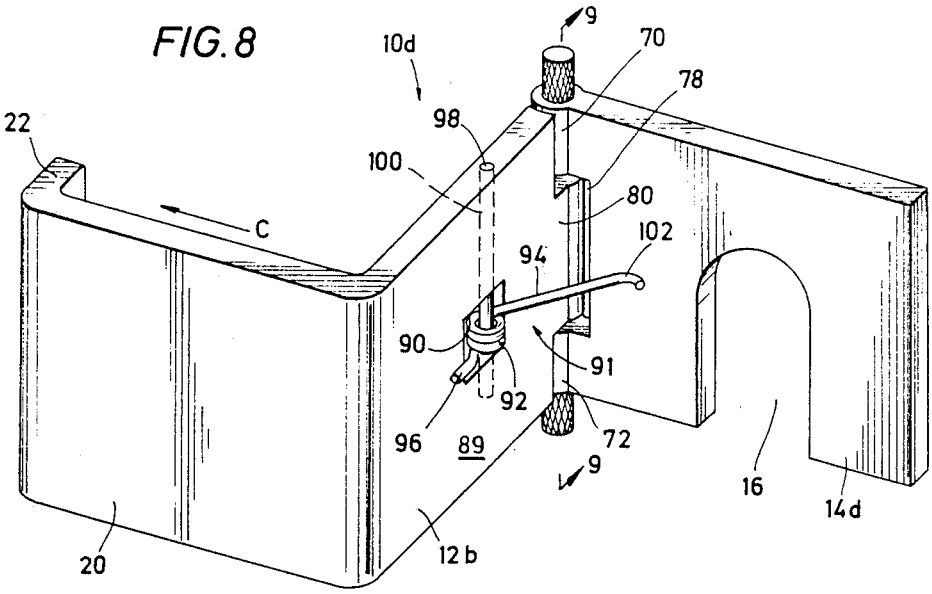
FIG. 9
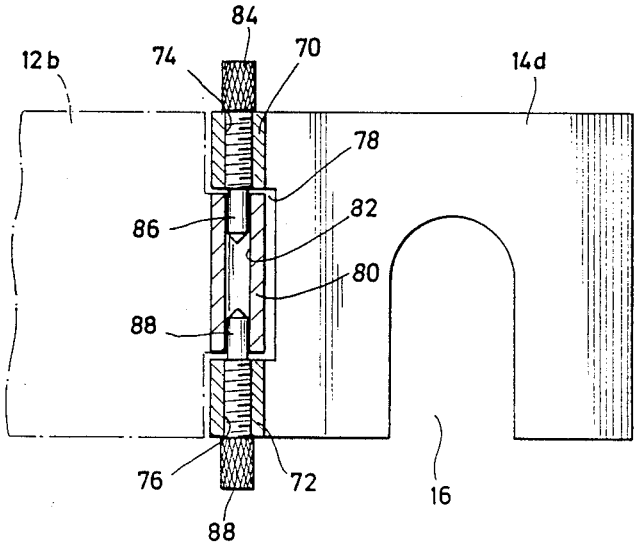
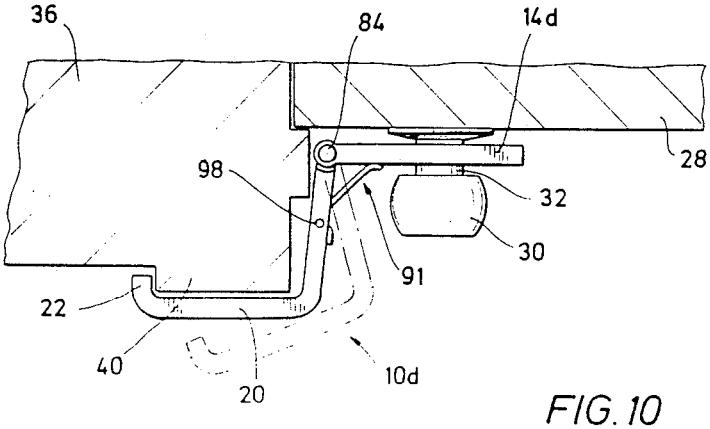
FIG. 10

DOOR SECURITY APPARATUS

BACKGROUND OF THE INVENTION

1. Field of the Invention

The present invention relates to a door security apparatus and, more particularly, to an apparatus for preventing opening of an inwardly opening door from a room or the like into which the door opens.

2. Description of the Background

The prior art abounds with numerous locks, braces and other devices designed to prevent unauthorized opening of a door. Most of such prior art apparatuses or devices, other than double keyed locks or the like, are designed to prevent opening of an inward swinging door from the outward swinging side.

As evidenced by the existence of double keyed locks, there is clearly a need for security devices which will prevent an inward swinging door from being opened from the inward swinging side, e.g. from a room into which the door swings open. For example, in most homes, there is one room which, because of its position, is more attractive to burglars or other intruders as a means of entrance into the home than other rooms. It is clearly desirable to be able to "isolate" such a room to the extent that if forced entry is made into the room by an intruder, access to the remainder of the home can be denied by virtue of the fact that the intruder is unable to open a door which swings into the room.

SUMMARY OF THE INVENTION

It is therefore an object of the present invention to provide a security apparatus for preventing opening of a hinged door from the inward swinging side.

Another object of the present invention is to provide a security apparatus for preventing opening of a hinged door from the inward swinging side which is portable and does not require the use of keys.

The above and other objects of the present invention will become apparent from the drawings, the description given herein and the appended claims.

The security apparatus of the present invention prevents opening of a hinged door from the inward swinging side, the door being received in a door frame having a door facing on the outward swinging side of the door frame, the door including a door knob extending from the outward swinging side and having a shaft portion. The apparatus includes a web portion which has first and second, spaced ends. A first flange portion depends in a first direction from the first end of the web portion and generally transversely thereto. The first flange portion also includes an engagement means which receives or engages at least a portion of the door knob and selectively prevents any substantial movement of said door knob away from said first flange, the engagement means being releasably engageable with the door knob or a portion thereof. A second flange portion depends from the web portion in a second direction which is generally opposite the direction in which the first flange portion extends, the second flange portion depending from a second end of the web portion and generally tranversely thereto. The second flange portion has an inner surface which faces in a direction toward an imaginary plane which passes through the first flange portion tranversely to the web portion. Accordingly, when the door is closed and the engagement means is in engagement with the door knob on the outward swinging side of the door, the inner surface of the second flange portion lies closely adjacent the door facing on the outward swinging side of the door frame.

BRIEF DESCRIPTION OF THE DRAWINGS

FIG. 4 is a fragmentary, elevational view, partly in section, showing another embodiment of the security apparatus of the present invention.

FIG. 5 is a view taken along the lines 5—5 of FIG. 4.

FIG. 6 is an elevational view showing the security apparatus of FIG. 4 being used to secure a door which is hinged on the right side.

FIG. 7 is a view similar to FIG. 6 showing the use of the security apparatus of FIG. 4 to secure a door which is hinged on the left side.

FIG. 8 is a perspective view showing another embodiment of the security apparatus of the present invention.

FIG. 9 is a view taken along the lines 9—9 of FIG. 8.

FIG. 10 is a view similar to FIG. 2 showing the use of the security apparatus of FIG. 8.

DESCRIPTION OF THE PREFERRED EMBODIMENTS

Figure 1:
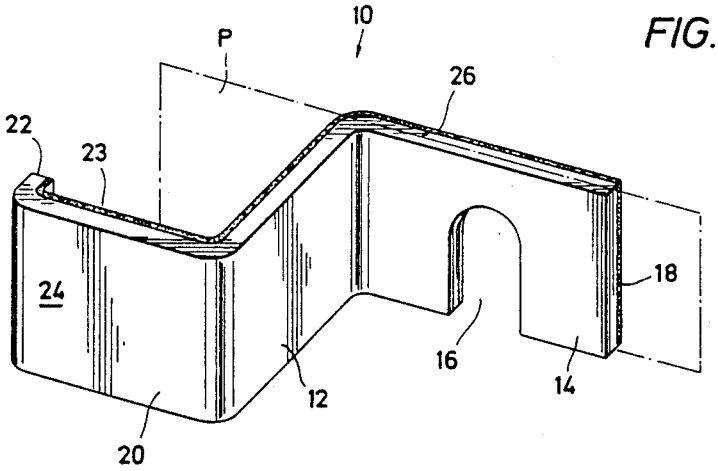
FIG. 1 is a perspective view of one embodiment of the security apparatus of the present invention.

Referring first to FIG. 1, the security apparatus shown generally as 10 includes a web portion 12 and a first flange portion 14, first flange portion 14 being attached to one end of web portion 12 and extending generally transversely thereto. First flange portion 14 includes a generally U-shaped notch or opening 16 disposed between the end of the first flange attached to the web portion 12 and the end 18 of the first flange portion distal the web portion. Security apparatus 10 further includes a second flange portion 20 attached to and depending from web portion 12, second flange portion 20 depending from the end of web portion 12 distal the end to which first flange portion 14 is attached. Second flange portion 20 extends transversely from web portion 12 in a direction generally opposite to that of first flange portion 14. A lip portion 22 depends from the end of the second flange portion distal the web portion, the lip portion 22 extending substantially in the same direction as the web portion 12. A shallow channel 23 is formed by lip portion 22, second flange portion 20 and web portion 12. Second flange portion 20 has an outer surface 24 and an inner surface (not shown). As can be seen in FIG. 1, the inner surface of second flange portion 20 faces in a direction toward an imaginary plane P which passes through the first flange 14 transversely to the web portion 12. A coating or sheathing of a plastic or similar substantially non-marring material 26 overlies the inner surface of second flange portion 20, the contiguous side of the web portion 12 and the contiguous side of the first flange portion 14.

Figure 2:
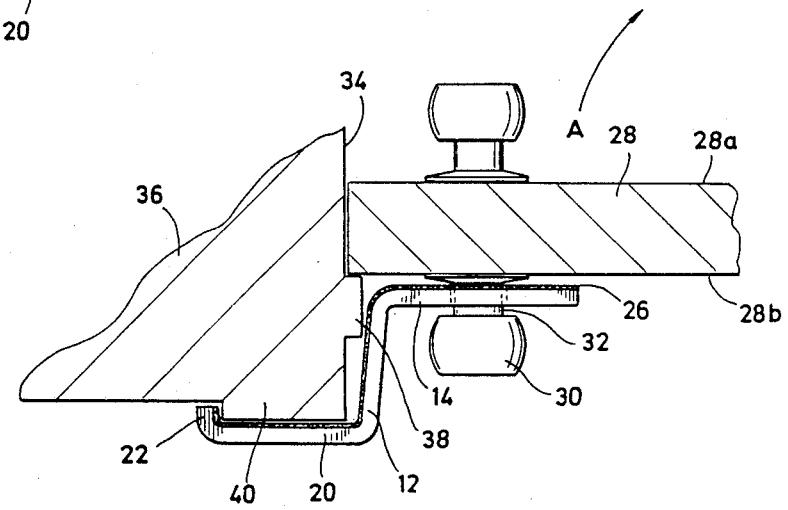
FIG. 2 is a top view, partly in section, showing the security apparatus of FIG. 1 being used to secure a door.

Referring now to FIG. 2, it can be seen how the security apparatus 10 can be used to prevent the opening of a hinged door from the inward swinging side. As shown, door 28 is hinged on the right side as viewed from the outward swinging side. A door 28 having a door knob 30 including a shaft portion 32 disposed therein is received in a door opening 34 formed by door jamb 36 which includes a door stop 38 and a door facing 40. As can be seen, door facing 40 is on the outward swinging side of door 28, i.e. door 28 is hinged to swing to the open position in the direction shown by the arrow A.

In the position shown in FIG. 2, door 28 is closed, i.e. door 28 abuts door stop 38 in the conventional fashion. In order to prevent door 28 from being opened from the inward swinging side 28*a*, security apparatus 10 is positioned such that the door facing 40 is received in the shallow channel 23. This is conveniently done by positioning security apparatus 10 above door knob 30. Once shallow channel 23 is positioned over door facing 40, security apparatus 10 can then be moved downwardly until notch 16 slides over shaft portion 32 of door knob 30. Notch 16 will thus function as an engagement means which can selectively engage and releasably hold door knob 30 against any substantial movement away from security apparatus 10. It will now be seen that any attempt to open door 28 from the inward swinging side 28*a* will be resisted due to the fact that the first flange portion 14 will engage the backside of the door knob 30, while the inner surface of the second flange portion 20 will engage the door facing 40. Thus, while some slight movement of door 28 is permitted, opening of door 28 sufficient to permit egress is prevented. It will be observed that lip portion 22 functions to keep security apparatus 10 properly positioned, i.e. it prevents security apparatus 10 from pivoting around shaft portion 32 of door knob 30. However, it is possible to construct security apparatus 10 in such a manner that frictional forces will hold second flange portion 20 against door facing 40. To this end, security apparatus 10 can be constructed of a material having sufficient resiliency to allow notch 16 to be fitted over shaft portion 32 with web portion 20 urged tightly against door facing 40. It will be appreciated that the coating or sheathing 26, being of a substantially non-marring material, prevents marring or scratching of door 28 or door facing 30 by apparatus 10 as it is positioned.

Figure 3:
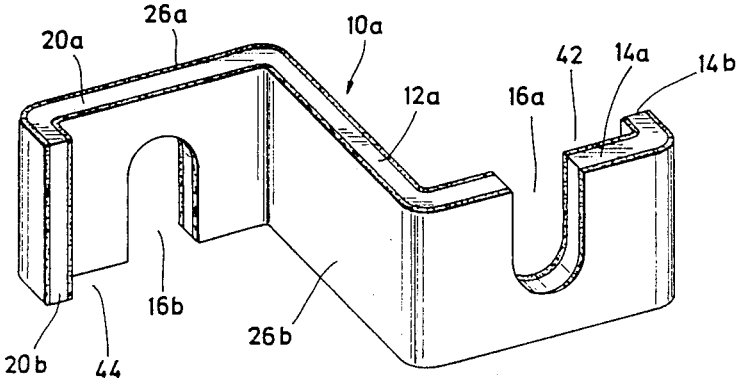
FIG. 3 is a perspective view of another embodiment of the security apparatus of the present invention.

Turning now to FIG. 3, there is shown another embodiment of the present invention which is adaptable to both right and left-handed, inwardly opening doors. In this regard, it will be noted that the security apparatus 10 shown in FIG. 1 is for a door which is hinged on the right side when viewed from the outward swinging side. The security apparatus, shown generally as 10*a*, includes a web portion 12*a*, first flange portion 14*a* and a second flange portion 20*a*, first and second flange portions 14*a* and 20*a* being attached to web portion 12*a* in the manner described above with respect to the security apparatus 10 shown in FIG. 1. Security apparatus 10*a* differs from security apparatus 10 in that both flange portions 14*a* and 20*a* are provided with notches shown as 16*a* and 16*b*, respectively. Notches 16*a* and 16*b* are disposed such that notch 16*a* opens in a direction opposite the direction of opening of notch 16*b*. First flange portion 14*a* is provided with a lip portion 14*b* while second flange portion 20*a* is provided with a lip portion 20*b*. As can be seen, lip portions 14*b* and 20*b* extend in substantially the same direction as web portion 12*a*. It can thus be seen that a shallow, first channel 42 is formed by first lip portion 14*b*, first flange portion 14*a* and web portion 12*a* and a second, shallow channel 44 is formed by second lip portion 20*b*, second flange portion 20*a* and web portion 12*a*. Security apparatus 10*a* is provided with a substantially non-marring coating or sheathing 26*a* which covers the inner surface (not shown) of first flange portion 14*a*, the contiguous side of the web portion 12*a* and the contiguous side of the second flange portion 20*a*. Additionally, security apaaratus 10*a* includes a second coating or sheathing 26*b* of a substantially non-marring material which covers the inner surface of flange portion 20*a*, the contiguous side of the web portion 12*a* and the contiguous side of the first flange portion 14*a*. It will be appreciated that security apparatus 10*a* is adaptable to both left or right-handed, inwardly opening doors.

Referring now to FIG. 4, there is shown yet another embodiment of the security apparatus of the present invention. The security apparatus 10*c* shown in FIG. 4 is identical in every respect with security apparatus 10 shown in FIG. 1 with the exception that first flange portion 14*c* is provided with a generally U-shaped slot 46 which extends around the perimeter of notch 16. Slot 46 is formed in first and second side surfaces, 48 and 50, respectively, and an arcuate end surface 52 interconnecting first and second side surfaces 48 and 50, surfaces 48, 50 and 52 serving to provide a generally U-shaped notch. Received in slot 46 is a generally U-shaped spring member 54, spring member 54 having a first leg 56 and a second leg 58, leg 56 being received in the portion of slot 46 formed in side surface 48, leg 58 being received in the portion of slot 46 formed in side surface 50. In order to secure spring 54 in slot 46, the walls defining end surface 52 are crimped as at 66. First and second legs 56 and 58 are provided with first and second projecting formations 60 and 62, respectively, projecting formation 60 extending out of first side surface 48, projecting formation 62 extending out of second side surface 50. It will be appreciated that first and second projecting formations 60 and 62 are resiliently movable into and out of slot 46, i.e. projecting formations 60 and 62 in the relaxed state (shown in FIG. 4) provide a narrower mouth into notch 16 than is provided by side surfaces 48 and 50. However, because of the resilient nature of the spring member 54, projections 60 and 62 can be forced apart, i.e. into slot 46, thereby increasing the opening therebetween.

Referring to FIG. 6, the security apparatus 10*c* is shown securing a hinged door which is hinged on the right side such as is shown in FIG. 2. It can be seen that the spring 54 and more specifically projecting formations 60 and 62 form an opening in notch 16 which is less than the diameter of shaft portion 32 of door knob 30. Accordingly, when the security apparatus 10*c* is affixed to door 28 in the manner described above with respect to security apparatus 10, projecting formations 60 and 62 will be spread apart from one another until shaft portion 32 is fully received in notch 16 whereupon projecting formations 60 and 62 will return to their relaxed position as shown in FIG. 6, thereby effectively trapping shaft portion 32 of door knob 30. Utilization of the spring 54 allows the security apparatus 10*c* to be used for both left and right-handed hinged doors. Thus, as can be seen in FIG. 7, the security device 10*c* is attached to a door 28 which is hinged on the left-hand side as viewed from the outward swinging side. To attach security apparatus 10*c*, it is positioned adjacent door 28 and facing 40 in substantially the same manner as that described with respect to security apparatus 10 in FIG. 2. However, in the case of security apparatus 10*c*, it would be initially positioned below door knob 30 and then moved upwardly in the direction shown by arrow B until shaft portion 32 forces projecting formations 60 and 62 apart and shaft portion 32 is fully received in notch 16, at which time projecting formations 60, 62 will return to their relaxed position shown in FIG. 7 thereby trapping shaft portion 32 in notch 16. This permits a security apparatus having only a single notch to be used for both left and right-handed opening doors. In effect, projecting formations 60 and 62 on spring 54 prevent security apparatus 10c from slipping downwardly off of shaft portion 32. Thus, shaft portion 32 can be selectively maintained in notch 16 by the action of spring 54.

Referring now to FIG. 8, there is shown another embodiment of the security apparatus **10*d*. Apparatus 10*d* differs from apparatus 10 primarily in the fact that first flange portion 14*d* is hingedly secured to web portion 12*d*. First flange portion 14*d* has first and second, spaced apart arms 70 and 72 defining first and second threaded bores 74 and 76, bores 74 and 76 being in register with one another. A recess 78 is formed between arms 70 and 72 for receiving a tongue portion 80 of web portion 12*b*, tongue portion 80 defining a bore 82. As best seen with reference to FIG. 9, when tongue portion 80 is received in recess 78, bores 74 and 76 are in register with bore 82. A first threaded hinge pin 84, threadedly received in bore 74, has a thread-free portion 86 which is received in one end of bore 82. A second threaded hinge pin 88, threadedly received in bore 76, has a thread-free portion 88 which is received in the other end of bore 82. Accordingly, first flange portion 14*d* can be pivoted relative to web portion 12*d*. In order to maintain the inner surface (not shown) of flange 20 in contact with the door facing 40 when the security apparatus 10*d* is in use, a biasing means is used to urge flange portion 20 against the door facing. A pocket is formed in surface 89 of web portion 12*b*. Received in pocket 89 is the coil 92 of a wire spring 91 having a first arm 94 and a second, shorter arm 96. Coil 92 is held in place by a pin 98 received in the bore 100 formed in web portion 12*b*, pin 98 extending across pocket 90. The distal end 102 of arm 94 is in engagement with first flange portion 14*d* while the second, shorter arm 96 is in engagement with web portion 12*b*. Accordingly, while web portion 12*b* can be pivoted relative to first flange portion 14*d*, the force of spring 91 tends to urge web portion 12*b* in the direction shown by arrow C. With reference to FIG. 10, it can be seen that apparatus 10*d* can be fitted to the door/door frame assembly by moving web portion 12*b* and its fixedly attached second flange portion 24 to the position shown in phantom in FIG. 10. First flange portion 14*d* can then be moved to a position where the shaft portion 32 is received in notch 16. At this point, web portion 12*b* having fixedly attached flange portion 24 can then be released whereupon spring 91 will urge flange portion 24 to the position shown in full in FIG. 10. By using the embodiment shown in FIGS. 8–10**, marring or scratching of the door facing or door is virtually eliminated, since it is unnecessary to slide the security apparatus along the door facing or the door.

It will be understood that the first flange portion can be any structure which carries or includes a means which is engageable with the door knob in such a way that it cannot be substantially moved away from the security apparatus without the engagement means being released out of engagement with the door knob.

The web and flange portions of the security apparatus can be made of numerous metallic or plastic materials. For example, materials such as aluminum and high-impact, high-strength polymeric materials may be employed.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. A security apparatus for preventing opening of a hinged door from the inward swinging side, said door being received in a door frame having a door facing on the outward swinging side of said door frame, said door including a door knob extending from the outward swinging side, said door knob having a shaft portion, comprising:

a web portion having first and second, spaced ends;

a first flange portion depending in a first direction from said first end of said web portion and generally transversely thereto;

a second flange portion depending in a second direction from a second end of said web portion and generally transversely thereto, said second direction being substantially opposite to said first direction, said second flange portion having an inner surface, said inner surface facing in a direction toward an imaginery plane passing through said first flange portion transversely to said web portion;

a lip portion depending from the end of said second flange portion distal said web portion, said lip portion extending in substantially the same direction as said web portion to thereby form a channel defined by said lip portion, said web portion and said second flange portion;

engagement means on said first flange for selectively releasably engaging at least a portion of said door knob and selectively preventing substantial movement of said door knob away from said first flange whereby, when said door is closed and said engagement means engages said door knob on said outward swinging side, said door facing on said outward swinging side of said door frame is received in said channel, whereby pivoting of said apparatus relative to said shaft is restrained sufficiently to maintain said apparatus properly positioned with respect to said door and said door frame.

2. The apparatus of claim 1 wherein said engagement means comprises a first notch formed in said first flange portion for receiving said shaft.

3. The apparatus of claim 2 wherein said notch lies between the end of said first flange portion depending from said web portion and the end of said first flange portion distal said web portion.

4. The apparatus of claim 2 wherein said second flange portion includes a second notch for receiving said shaft, said second notch being disposed between the end of said second flange portion depending from said web portion and the end of said second flange portion distal said web portion, said first notch opening in a direction opposite the direction of opening of said second notch.

5. The apparatus of claim 4 including a lip portion depending from the end of said first flange portion distal said web portion, said lip portions on said first and second flange portions extending in substantially the same direction as said web portion, a channel being formed by said first flange portion, said web portion and said first lip portion.

6. The apparatus of claim 1 wherein said first flange portion is hingedly secured to said web portion.

7. The apparatus of claim 6 including biasing means operatively connected between said web portion and said first flange portion to restrain relative movement of said first flange portion toward said web portion.

8. The apparatus of claim 2 including means for selectively maintaining said shaft in said notch.

9. The apparatus of claim 8 wherein said first notch is generally U-shaped and is defined by first and second, spaced side surfaces and an end surface interconnecting said first and second side surfaces, and wherein there is a generally U-shaped slot formed in said first and second side surfaces and said end surface, spring means received in said slot, said spring means having a first leg received in said portion of said slot in said first surface and a second leg received in said portion of said slot in said second surface, said first and second legs having first and second projecting formations, said first and second projecting formations extending out of said first and second side surfaces, respectively, into said U-shaped opening, said first and second projecting formations being resiliently movable into and out of said slot whereby said shaft can be selectively moved into and maintained in said notch by said first and second projecting formations.

10. The apparatus of claim 2 wherein said inner surface of said second flange, the contiguous side of said web portion and the contiguous side of said first flange portion are covered with a substantially non-marring material.

* * * * *